US006408499B1

(12) United States Patent
Roton et al.

(10) Patent No.: US 6,408,499 B1
(45) Date of Patent: Jun. 25, 2002

(54) ASSEMBLY PLATFORM SYSTEM FOR CEILING FANS

(76) Inventors: James R. Roton; Jacqueline Roton, both of 808 Jefferson St., Minden, LA (US) 71055

( * ) Notice: Subject to any disclaimer, the term of this patent is extended or adjusted under 35 U.S.C. 154(b) by 0 days.

(21) Appl. No.: 09/456,735

(22) Filed: Dec. 8, 1999

(51) Int. Cl.[7] ..... B25B 27/14

(52) U.S. Cl. ..... 29/281.1; 29/281; 29/5; 269/287

(58) Field of Search ..... 108/25, 26; 224/275; 312/211, 279; 269/287, 289 R, 294, 76, 69; 29/281.5, 281.1

(56) References Cited

U.S. PATENT DOCUMENTS 3,688,707 A 9/1972 White
4,099,811 A 7/1978 Barry
4,186,784 A 2/1980 Stone
5,267,384 A * 12/1993 Teeslink ..... 269/287
5,427,292 A 6/1995 Rousch
5,556,084 A * 9/1996 Hodges ..... 269/287
5,592,884 A 1/1997 Gleck et al.
6,012,210 A * 1/2000 Stadjuhar et al. ..... 29/281.5

* cited by examiner

*Primary Examiner*—Robert C. Watson

(57) ABSTRACT

An assembly platform for supporting the various parts and sub assemblies of a ceiling fan while other parts and sub-assemblies of the ceiling fan are attached prior to installing the ceiling fan. The assembly platform includes a round, cylinder shaped, open-ended, plastic support tube, a fan part support shelf, and a number of insert structures.

1 Claim, 1 Drawing Sheet

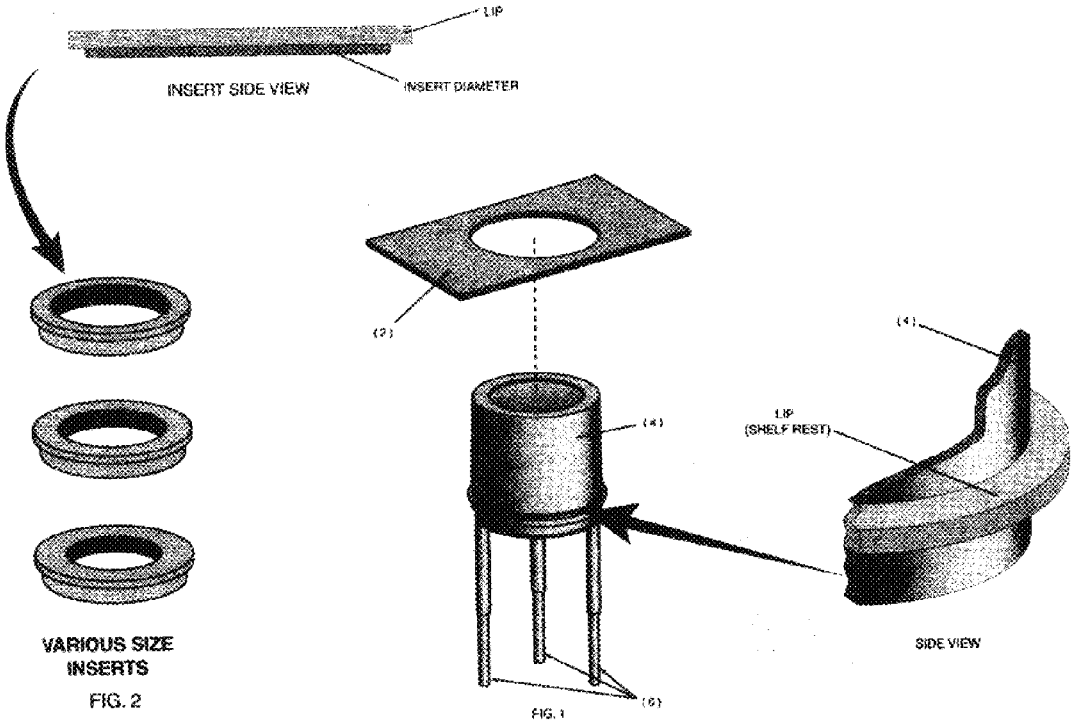
DETAIL A

ASSEMBLY PLATFORM SYSTEM FOR CEILING FANS

TECHNICAL FIELD

The present invention relates to assembly platforms for items that must be partially assembled on site before installation and more particularly to an assembly platform system for ceiling fans for supporting the elements of a ceiling fan assembly during partial assembly of the ceiling fan unit prior too installation of the ceiling fan; the assembly platform system for ceiling fans including a round, cylinder shaped, open-ended, plastic support tube, a fan part support shelf, and a number of insert structures; the round, cylinder shaped, open-ended, plastic support tube having an exterior cylinder diameter, three telescoping leg assemblies extending from an exterior cylinder bottom surface, a ring shaped shelf support flange extending around the circumference of the exterior side surface of the support tube and extending outward a first extension distance from the exterior side surface of the support tube, and a fan portion receiving cavity formed within the support tube and accessible through a round opening having an interior opening diameter; the fan part support shelf having a round cylinder passage opening having a shelf aperture diameter greater than the exterior cylinder diameter but less than the sum of the exterior cylinder diameter and twice the first extension distance such that the ring shaped shelf support supports the fan part support shelf when the support tube is inserted through the round cylinder passage opening; the number of insert structures each including an insertion flange sized to friction fit into the round opening of the support tube and a fan portion passage opening having a diameter less than the interior opening diameter of the round opening.

BACKGROUND ART

It is often necessary to assembly a ceiling fan before installing the ceiling fan. This assembly usually includes the attachment of the blades and in some case a down rod. It would be a benefit, therefore, to have an assembly platform system for ceiling fans that supported the various parts and sub assemblies of the ceiling fan while other parts are sub-assemblies of the ceiling fan are attached prior to installing the ceiling fan.

GENERAL SUMMARY DISCUSSION OF INVENTION

It is thus an object of the invention to provide an assembly platform system for ceiling fans for supporting the elements and sub-assemblies of a ceiling fan assembly during partial assembly of the ceiling fan unit prior too installation of the ceiling fan; the assembly platform system for ceiling fans including a round, cylinder shaped, open-ended, plastic support tube, a fan part support shelf, and a number of insert structures; the round, cylinder shaped, open-ended, plastic support tube having an exterior cylinder diameter, three telescoping leg assemblies extending from an exterior cylinder bottom surface, a ring shaped shelf support flange extending around the circumference of the exterior side surface of the support tube and extending outward a first extension distance from the exterior side surface of the support tube, and a fan portion receiving cavity formed within the support tube and accessible through a round opening having an interior opening diameter; the fan part support shelf having a round cylinder passage opening having a shelf aperture diameter greater than the exterior cylinder diameter but less than the sum of the exterior cylinder diameter and twice the first extension distance such that the ring shaped shelf support supports the fan part support shelf when the support tube is inserted through the round cylinder passage opening; the number of insert structures each including an insertion flange sized to friction fit into the round opening of the support tube and a fan portion passage opening having a diameter less than the interior opening diameter of the round opening.

Accordingly, than the interior opening diameter of the round opening. An assembly platform system for ceiling fans is provided. The assembly platform system for ceiling fans includes a round, cylinder shaped, open-ended, plastic support tube, a fan part support shelf, and a number of insert structures; the round, cylinder shaped, open-ended, plastic support tube having an exterior cylinder diameter, three telescoping leg assemblies extending from an exterior cylinder bottom surface, a ring shaped shelf support flange extending around the circumference of the exterior side surface of the support tube and extending outward a first extension distance from the exterior side surface of the support tube, and a fan portion receiving cavity formed within the support tube and accessible through a round opening having an interior opening diameter; the fan part support shelf having a round cylinder passage opening having a shelf aperture diameter greater than the exterior cylinder diameter but less than the sum of the exterior cylinder diameter and twice the first extension distance such that the ring shaped shelf support supports the fan part support shelf when the support tube is inserted through the round cylinder passage opening; the number of insert structures each including an insertion flange sized to friction fit into the round opening of the support tube and a fan portion passage opening having a diameter less

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein:

FIG. 1 is a perspective view of an exemplary embodiment of the assembly platform system for ceiling fans showing the round, cylinder shaped, open-ended, plastic support tube having an exterior cylinder diameter, three telescoping leg assemblies extending from an exterior cylinder bottom surface, a ring shaped shelf support flange extending around the circumference of the exterior side surface of the support tube and extending outward a first extension distance from the exterior side surface of the support tube, and a fan portion receiving cavity formed within the support tube and accessible through a round opening having an interior opening diameter; a fan part support shelf having a round cylinder passage opening having a shelf aperture diameter greater than the exterior cylinder diameter but less than the sum of the exterior cylinder diameter and twice the first extension distance such that the ring shaped shelf support supports the fan part support shelf when the support tube is inserted through the round cylinder passage opening; and a number of insert structures each including an insertion flange sized to friction fit into the round opening of the support tube and a fan portion passage opening having a diameter less than the interior opening diameter of the round opening.

FIG. 2 is a perspective view of the an assembled configuration of the assembly platform system for ceiling fans of FIG. 1 showing the round, cylinder shaped, open-ended, plastic support tube the three telescoping leg assemblies extended downward from the exterior cylinder bottom surface; the fan part support shelf with the round cylinder passage opening positioned over the exterior surface of the support tube and supported on the ring shaped shelf support; and one of the insert structures with the insertion flange thereof friction fit into the round opening of the support tube.

EXEMPLARY MODE FOR CARRYING OUT THE INVENTION

FIG. 1 shows an exemplary embodiment of the assembly platform system for ceiling fans of the present invention generally designated 10. Assembly platform system 10 includes a round, cylinder shaped, open-ended, plastic support tube, generally designated 12; a fan part support shelf, generally designated 14; and three insert structures, generally designated 16*a,* 16*b,* 16*c,* respectively.

Round, cylinder shaped, open-ended, plastic support tube 12 includes a twelve inch long plastic tube section 20 having an exterior cylinder diameter "A" of ten inches; three telescoping leg assemblies, each generally designated 22 extending from an exterior cylinder bottom surface 24 a distance of three feet; a ring shaped shelf support flange 26 extending around the circumference of a exterior side surface 28 of tube section 20 and extending outward a first extension distance "B" of one-half inch from exterior side surface 28 of tube section 20; and a fan portion receiving cavity formed entirely through tube section 20 and accessible through a top round opening 32 having an interior opening diameter "C" of eight inches.

Fan part support shelf 14 is a rectangular plastic member having a round cylinder passage opening having a shelf aperture diameter "D" of ten and one-quarter inch which is greater than the exterior cylinder diameter "A" of ten inches but less than the sum of the than the exterior cylinder diameter "A" and twice the first extension distance "B" such that the ring shaped shelf support 26 supports the fan part support shelf 14 when tube section 20 is inserted through the round cylinder passage opening 38.

The three insert structures 16*a–c* each include an insertion flange 40 having a diameter "E" substantially equal to diameter "C" sized to friction fit into round opening 32 of support tube 20 and a fan portion passage opening 42*a–c* each having a different sized diameter less than diameter "E".

FIG. 2 shows an assembled configuration of assembly platform system for ceiling fans 10 of FIG. 1 showing the round, cylinder shaped, open-ended, plastic support tube 12, the three telescoping leg assemblies 22 extended downward from the exterior cylinder bottom surface 24; the fan part support shelf 14 with the round cylinder passage opening 38 (see also FIG. 1) positioned over the exterior surface 28 of support tube 12 and supported on the ring shaped shelf support 26 (FIG. 1); and one of the insert structures 16*a* with the insertion flange 40 (FIG. 1) thereof friction fit into the round opening 32 (FIG. 1) of the support tube 12.

It can be seen from the preceding description that an assembly platform system for ceiling fans has been provided.

It is noted that the embodiment of the assembly platform system for ceiling fans described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An assembly platform system for ceiling fans comprising:

a round, cylinder shaped, open-ended, support tube;

a fan part support shelf; and a number of insert structures;

said round, cylinder shaped, open-ended, support tube having an exterior cylinder diameter, three telescoping leg assemblies extending from an exterior cylinder bottom surface, a ring shaped shelf support flange extending around said circumference of said exterior side surface of said support tube and extending outward a first extension distance from an exterior side surface of said support tube, and a fan portion receiving cavity formed within said support tube and accessible through a round opening having an interior opening diameter;

said fan part support shelf having a round cylinder passage opening having a shelf aperture diameter greater than said exterior cylinder diameter but less than the sum of said exterior cylinder diameter and twice said first extension distance such that said ring shaped shelf support supports said fan part support shelf when said support tube is inserted through said round cylinder passage opening;

said number of insert structures each including an insertion flange sized to friction fit into said round opening of said support tube and a fan portion passage opening having a diameter less than said interior opening diameter of said round opening.

* * * * *